United States Patent [19]

Snavely

[11] Patent Number: 4,928,568

[45] Date of Patent: May 29, 1990

[54] COLOR ORGAN DISPLAY DEVICE

[76] Inventor: Donald E. Snavely, 210 N. Hoover Ave., New Holland, Pa. 17557

[21] Appl. No.: 337,153

[22] Filed: Apr. 12, 1989

[51] Int. Cl.[5] ..... A63J 17/00

[52] U.S. Cl. ..... 84/464 R; 84/464 A; 362/97

[58] Field of Search ..... 84/464 A, 464 R; 362/97

[56] References Cited

U.S. PATENT DOCUMENTS

| | | | |
|---|---|---|---|
| 3,540,343 | 11/1970 | Rifkin | 84/464 |
| 3,635,121 | 1/1972 | Knauff | 84/464 |
| 3,845,468 | 10/1974 | Smith | 340/148 |
| 4,000,679 | 1/1977 | Norman | 84/464 |
| 4,265,159 | 5/1981 | Liebman et al. | 84/464 R |
| 4,358,754 | 11/1982 | Young et al. | 340/815 |

*Primary Examiner*—Patrick R. Salce
*Assistant Examiner*—Emanuel Todd Voeltz
*Attorney, Agent, or Firm*—Larry W. Miller

[57] ABSTRACT

A color organ display device is operable to produce a unique display of light emanations in response to sound inputted thereto. The color organ display device utilizes a plurality of light bulbs arranged in discrete groups and projecting outwardly beyond a reflective backing so that the light bulbs cast a distinct image to the observer. Each group of light bulbs is illuminated in response to the existence of audio input present in a corresponding frequency range with the brightness of the light bulb illumination being directly proportional to the amplitude of the signal from the corresponding frequency channel and, therefore, directly proportional to the volume of sound in that particular frequency range. The color organ display device can be supported in a frame adaptable for mounting on a wall or for mounting on a stand. The display device can also be incorporated into a table to provide visual entertainment corresponding to the music being heard by the users of the table.

14 Claims, 5 Drawing Sheets

W
34
10
D
A
45
C
40
D
31
B
B
40
6
6
12
14
D
C
A
15
45
D 15
15a
18
14
16
17

15
40
15a
45
14
16
17

15a
49
15
45
14
16
17

Fig. 8
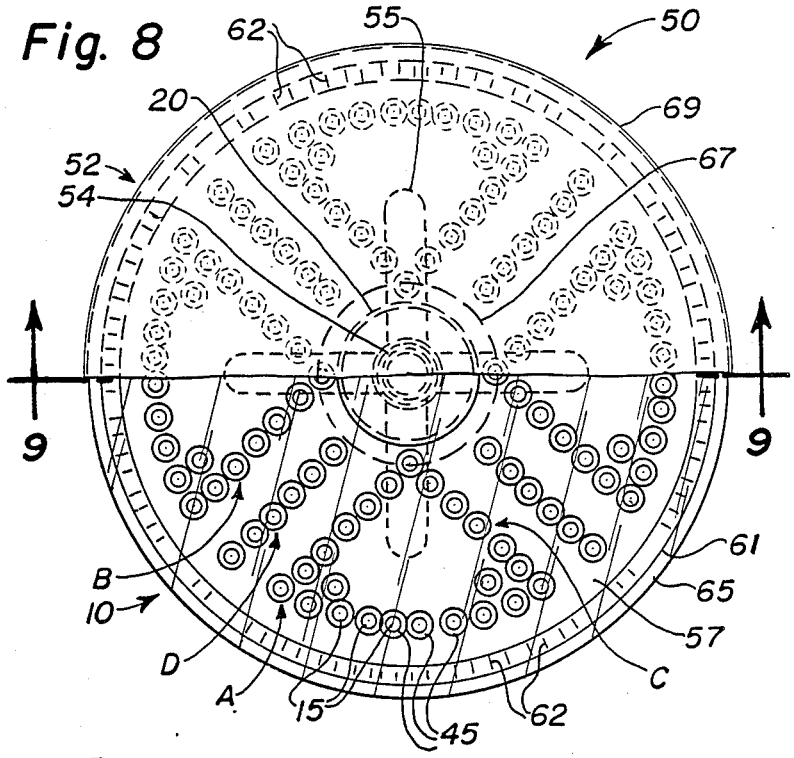
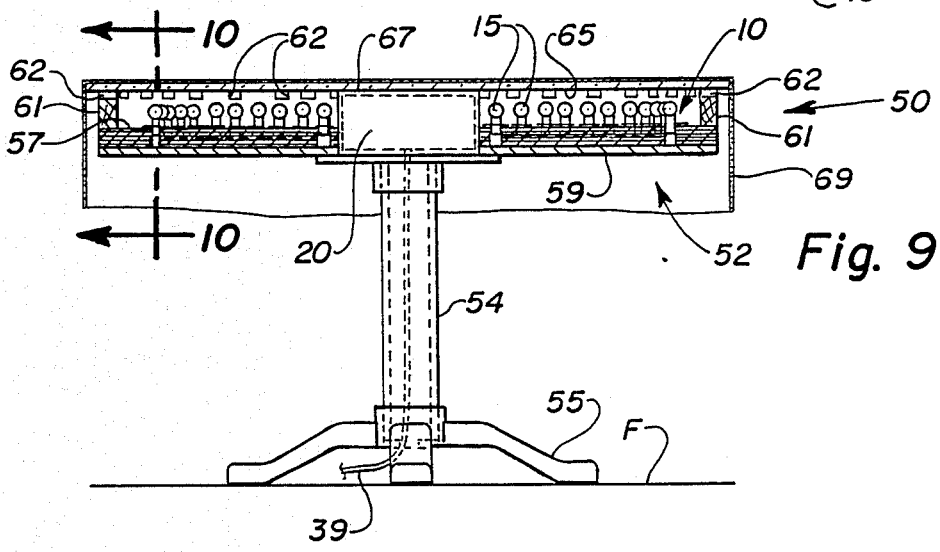
Fig. 9
Fig. 10
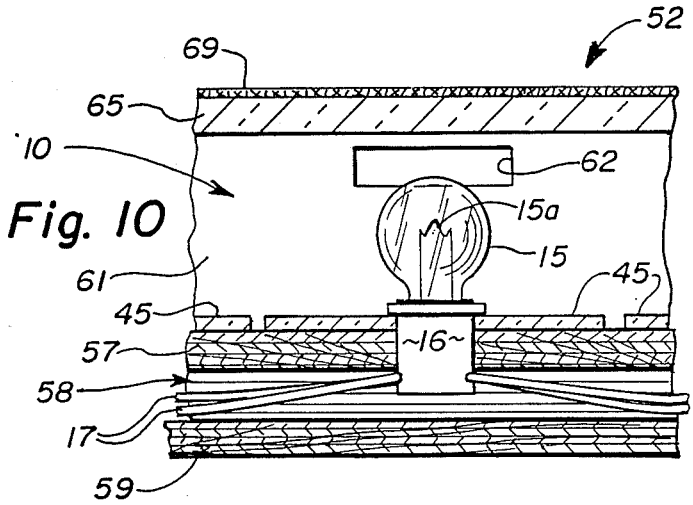

COLOR ORGAN DISPLAY DEVICE

BACKGROUND OF THE INVENTION

The present invention relates generally to color organs which can be generally defined as being an electronic device driving a lighted display responsive to sound, such as music, and, more particularly, to a device operable for visually displaying sounds detected in individual frequency bands by differently colored light groups corresponding to such bands and being arranged in a pattern.

Color organs are generally known in the prior art as shown in U.S. Pat. Ser. No. 4,358,754 and 3,845,468. These prior art display devices typically flash light bulbs on and off in a rhythmic response to the sound signals received thereby. Translucent panels cover the prior art color organ displays to diffuse the light rays emanating from the colored bulbs, thereby making the display show intermeshing light images to the observer rather than discrete points of light. Furthermore, known color organ displays have not been made conducive to use in a variety of applications such as in furniture or multifunctional display arrangements that could be mounted on a wall or be free-standing.

Also, known color organ display devices do not provide a distinct pattern responsive to the sound signals inputted thereto. By breaking the sound signals into a plurality of bands or channels and by arranging the light bulbs in the display device into a discrete pattern, the visual display of music or other sound inputted into the device can achieve a distinct pattern of light impulses from the respective light groups. The use of such a display can provide a visual display of sound, particularly music, to those who cannot adequately hear the sound of the music, with each song having a unique display pattern responsive to the intensity of the signal of the sound in each respective band or channel. Such displays of light patterns responsive to music also provide a source of entertainment associated with the playing of music to visually enhance the appreciation thereof.

Accordingly, it would be desirable to provide an improved color organ display device that could be used in a more varied manner with an attractive display pattern responsive to the sound pattern inputted through a plurality of channels.

SUMMARY OF THE INVENTION

It is an object of this invention to overcome the aforementioned disadvantages of the prior art by providing a color organ display having groups of light bulbs arranged in a discrete pattern and illuminated in a manner responsive to the signal received for a corresponding frequency band of the sound being displayed.

It is another object of this invention to provide a color organ display that provides a unique pattern of light images in response to sound signals inputted thereto.

It is still another object of this invention to provide a color organ display device that can be incorporated into furniture such as a table.

It is a feature of this invention that the color organ display is constructed so that the light bulbs are arranged in a specific pattern and exposed to view without diffusion to permit the pattern of light images to be distinct.

It is an advantage of this invention that bulbs having a distinctively viewable filament can be utilized to provide a distinctive pattern of light images.

It is another feature of this invention that the color organ display device is constructed with the light bulbs projecting outwardly beyond a reflective backing to bounce the light rays outwardly toward the observer.

It is another advantage of this invention that the reflective backing behind the exposed light bulbs establish a distinctive array of light images visible to the observer.

It is yet another advantage of this invention that the display device is incorporated into a frame that can be wall mounted or mounted on a stand to permit the face of the display device to be oriented at an acute angle to vertical to enhance the image reflected off the reflective backing behind the light bulbs.

It is still another advantage of this invention that the frame for the display device will accommodate a transparent cover to protect the light bulbs exposed beyond the reflective backing without detracting from the image pattern emanating therefrom.

It is yet another object of this invention to provide a color organ to drive the illumination of groups of light bulbs wherein the frequency of the audio input determines the color of the light to be generated from the display and the amplitude of the audio input determines the brightness of the light generated.

It is still another feature of this invention that each group of light bulbs illuminates in response to the sound present within a corresponding specified frequency range.

It is yet another advantage of this invention that the illumination of groups of light bulbs within a discrete pattern in response to the sound present within corresponding frequency bands provides a pattern of images unique to each sound displayed on the color organ display device.

It is a further object of this invention to provide a table incorporating the color organ display device.

It is yet another feature of this invention that the table incorporating the color organ display device will provide a visual display of music being played for the people utilizing the table.

It is still another feature of this invention that the signals for driving the color organ display device can be transmitted through the electrical current power supply wires.

It is a further advantage of this invention that the sound being inputted into the color organ display device results in a unique visual display of that sound so that hearing impaired people can see sound in an esthetically pleasing form.

It is still a further object of this invention to provide a color organ display device that is durable in construction, inexpensive of manufacture, carefree of maintenance, facile in assemblage, and simple and effective in use.

These and other objects, features and advantages are accomplished according to the instant invention by providing a color organ display device operable to produce a unique display of light emanations in response to sound inputted thereto. The color organ display device utilizes a plurality of light bulbs arranged in discrete groups and projecting outwardly beyond a reflective backing so that the light bulbs cast a distinct image to the observer. Each group of light bulbs is illuminated in response to the existence of audio input present in a corresponding frequency range with the brightness of the light bulb illumination being directly proportional to the amplitude of the signal from the corresponding frequency channel and, therefore, directly proportional to the volume of sound in that particular frequency range. The color organ display device can be supported in a frame adaptable for mounting on a wall or for mounting on a stand. The display device can also be incorporated into a table to provide visual entertainment corresponding to the music being heard by the users of the table.

BRIEF DESCRIPTION OF THE DRAWINGS

The advantages of this invention will become apparent upon consideration of the following detailed disclosure of the invention, especially when taken in conjunction with the accompanying drawings wherein:

FIG. 8 is a top plan view of a table incorporating the color organ display device and being covered by a table cloth which is partially broken away to better see the color organ, the color organ depicted being the embodiment similar to that shown in FIG. 4 with the reflective disks positioned behind the light bulbs;

FIG. 9 is a cross-sectional view of the table corresponding to lines 9—9 of FIG. 8;

FIG. 10 is a partial cross-sectional view of the table corresponding to lines 10—10 of FIG. 9 to show the details of mounting the light bulb in the display device;

DETAILED DESCRIPTION OF THE PREFERRED EMBODIMENT

Figure 1:
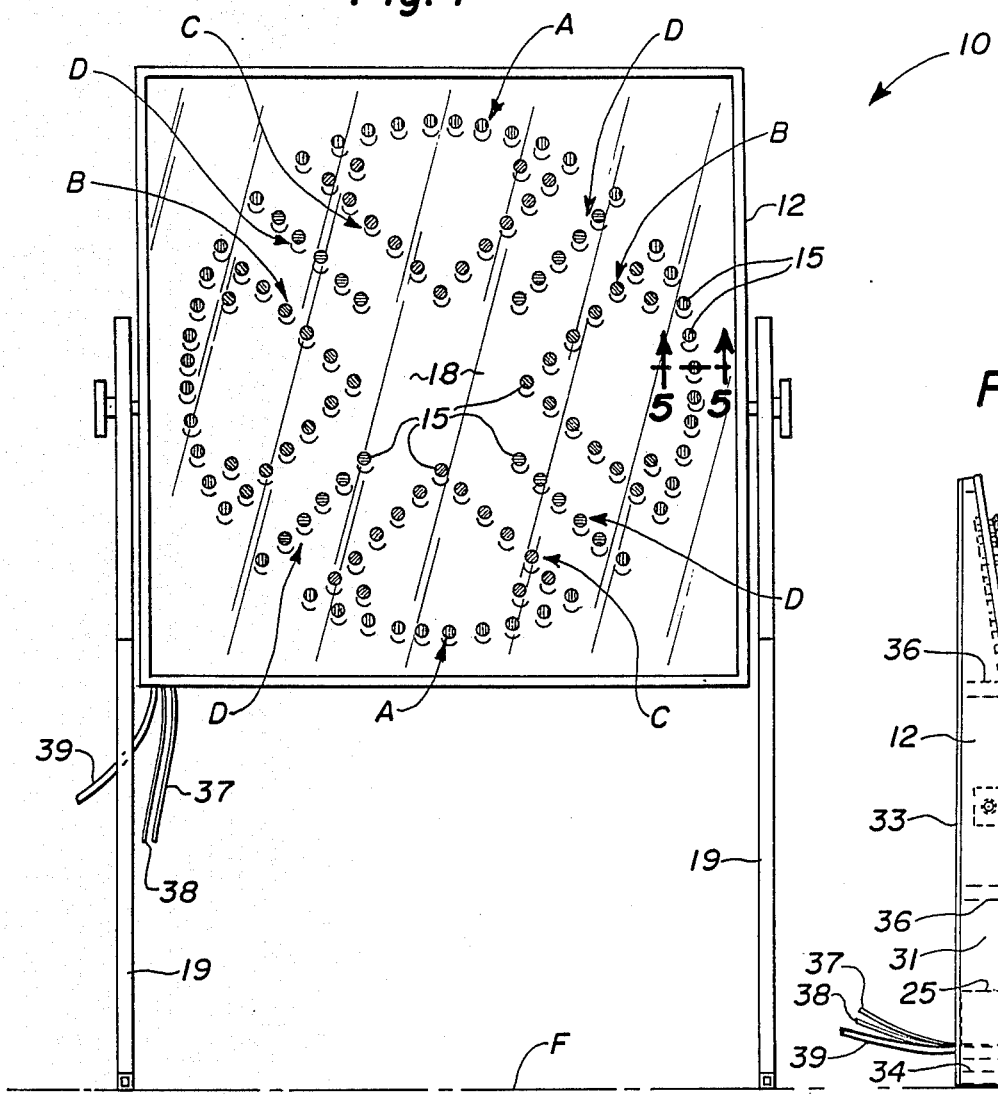
FIG. 1 is a front elevational view of the color organ display device incorporating the principles of the instant invention, the device being mounted in a detachable display stand to permit adjustable rotative movement thereof.

Referring now to the drawings and, particularly, to FIGS. 1–3 and 5, the color organ display device 10 incorporating the principles of the instant invention can be seen. The device 10 includes as the basic components a frame 12, a faceplate 14, light bulbs 15 mounted in the faceplate 14 and exposed outwardly therefrom for viewing by the observer, a reflective backing 18 supported on the faceplate 14 behind the bulbs 15, and a color organ 20 diagrammatically depicted in FIG. 13 to drive the illumination of the light bulbs 15. The term, color organ 20, is used throughout this specification and claims to refer specifically to the electronic apparatus or device operably connected to the display device 10 to effect an illumination of the light bulbs of the various groups of light bulbs as described in greater detail below.

Referring specifically to FIG. 1, it can be seen that the light bulbs 15 are arranged into discrete groups A, B, C, and D, which in turn define a pattern. The bulbs 15 of each specific group are of a like color. Group A is defined as the light bulbs 15 around the perimeter of the pattern and is marked with vertical cross-hatching. Group B of the pattern depicted in FIG. 1 is defined by the light bulbs 15 in the two horizontally opposing arrowheads and is marked with diagonal cross-hatching extending from the upper left to the lower right. Group C of the pattern is defined by the light bulbs 15 in the two vertically opposing arrowheads and is marked with diagonal cross-hatching extending from upper right to lower left. Group D of the pattern is defined by the linearly arranged light bulbs 15 positioned between the aforementioned arrowheads, inside of the peripheral Group A, and forming an "X" configuration. The bulbs 15 of Group D are marked with horizontal cross-hatching.

Figure 12:
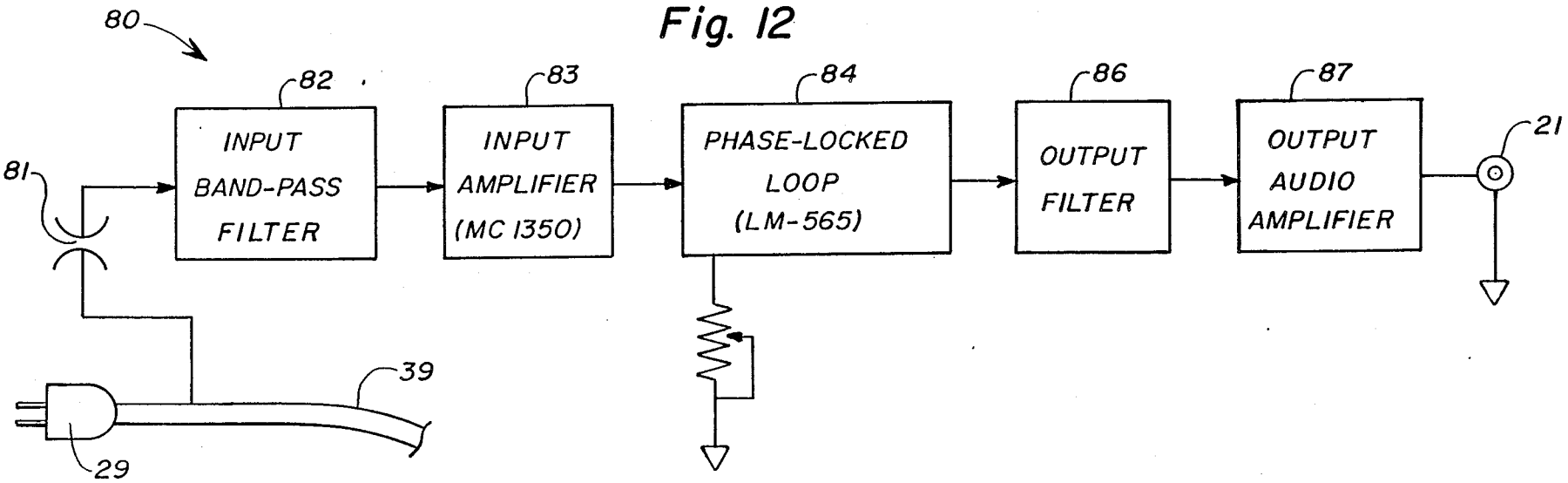
FIG. 12, is a schematic block diagram of the FM receiver operably associated with the color organ display device to receive signals from the electrical wiring transmitted by the FM transmitter diagrammatically depicted in FIG. 11 and input the signals to the color organ.
Figure 13:
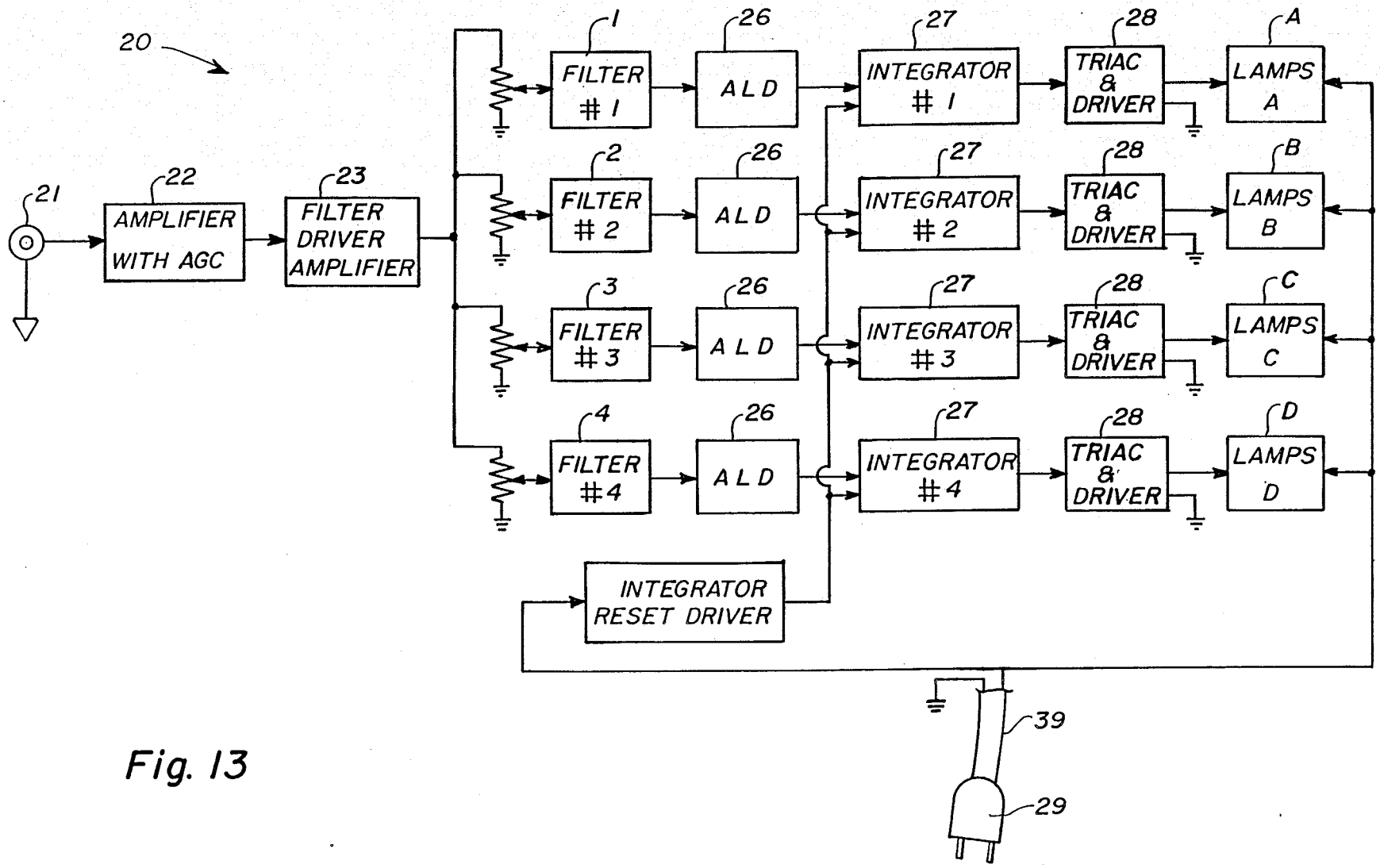
FIG. 13 is a schematic block diagram of the four channel audio driven color light synthesizer forming a part of the color organ display device shown in FIGS. 1–10.

Referring now to FIG. 13, one skilled in the art will readily recognize a four channel audio driven colored light synthesizer, referred to hereinafter as a color organ 20. The color organ 20 receives a gross signal from a source of sound signal, such as a direct wire connection with the speaker wire of a stereo system or from the FM transmitter and receiver shown in FIGS. 11 and 12 and described in greater detail below, through an input jack 21. After processing the gross signal through an input isolation amplifier with AGC 22 and a filter driver amplifier 23, the gross signal is divided into four channels by respective active band-pass filters 1, 2, 3, and 4 coupled through channel gain adjusters 24. The processed signals from the filters 1, 2, 3, and 4 correspond to four frequency ranges and are further processed by respective audio level detectors and processors (ALD) 26 and integrators 27 to a corresponding TRIAC and driver 28 to effect illumination of the light bulbs 15 in respective Groups A, B, C, and D from standard 60 Hz. electrical current via electrical plug 29 and wire 39.

For purposes of exemplary demonstration, the frequency range for band-pass filter 1 and corresponding Group A could be identified as bass with the light bulbs 15 colored blue. Similarly, the band-pass filter 2 and corresponding light bulb Group B could be identified as treble with the light bulbs 15 colored red. The difference in frequency ranges identified above as bass and treble could also be divided into two bands and identified as near-bass and near-treble. By way of example, the band-pass filter 3 could define the near-bass frequency range and correspond to light bulbs 15 in Group C colored green, while the near-treble range is defined by band-pass filter 4 and corresponds to Group D light bulbs 15 colored yellow.

The color organ 20 described above will effect illumination of the light bulbs 15 in each respective Group A, B, C, and D whenever the color organ detects the presence of sound within the respective frequency ranges defined by the band-pass filters 1, 2, 3, and 4. The brightness of the illumination of the light bulbs 15 in each respective Group A, B, C, and D is directly proportionate to the amplitude of the signal corresponding to that particular frequency range. Accordingly, the greater the sound volume within any given frequency range, the brighter the light bulb illumination of the light bulbs 15 in the corresponding Group A, B, C, and D. For example, the sound of a soprano's voice may brightly illuminate the light bulbs 15 in Group B, given the exemplary parameters defined above, while none of the light bulbs 15 in any of the other Groups A, C and D would be illuminated at all. Conversely, the beating of a bass drum would effect the off and on illumination of the light bulbs 15 in Group A, the bulbs 15 being illuminated at each beat of the drum and turned off between the beats, while none of the light bulbs 15 of the other Groups B, C, and D would become illuminated.

With each Group A, B, C, and D of light bulbs 15 becoming illuminated in response to the presence of a sound signal within the corresponding frequency ranges and with the intensity of the illumination being proportionate with the volume of sound with the corresponding frequency ranges, each sound, whether musical or spoken voice, etc., being composed of different combinations of sound frequencies within the respective frequency ranges, will result in a different pattern on the color organ display device 10. A musical piece, for example, will result in a constantly changing series of light images from the illumination of the light bulb Groups A, B, C, and D. Each song will, therefore, have a different image pattern and will result in a unique visual display of the sound of that particular song.

Referring specifically to FIGS. 1–3 and 5, the color organ display device 10 is provided with a frame 12 having triangularly-shaped side members 31 supporting the faceplate 14 at a acute angle to the plane of the backplate 33 which extends generally perpendicularly to the base 34. Each side member 31 is adapted for pivotal connection to a stand 19 to support the color organ display device 10 above the floor F. The frame 12 is also provided with a number of struts 36 disposed between the backplate 33 and the faceplate 14 to adequately support the faceplate 14 to prevent a warping thereof. A reflective backing 18 is affixed to the exterior surface of the faceplate 14 to form a mirrored surface for the viewing of an observer of the display device 10.

Figure 5:
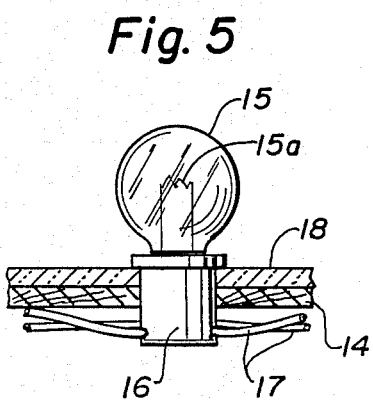
FIG. 5 is a partial cross-sectional view of the display device corresponding to lines 5—5 of FIG. 1 to depict the details of the mounting of the light bulbs with the reflective backing behind the bulb.

As specifically shown in FIG. 5, the faceplate 14 and reflective backing 18 are punctured by a plurality of holes in the shape of the patterns to be defined by the light bulb Groups A, B, C, and D. A light socket 16 is mounted in the faceplate 14 through the holes therethrough such that the reflective backing 18 surrounds the bulb 15 with the bulb 15 projecting outwardly therefrom. The filaments 15*a* of the light bulbs 15 are spaced outwardly from the reflective backing 18 and the faceplate 14 to permit an adequate bounce of the light energy emanating therefrom off the reflective backing 18. The struts 36 are routed to form channels to accommodate the passage of the wiring 17 for the sockets 16 and the occurrence of the sockets 16 themselves when positioned over a strut 36. The wiring 17 interconnects the sockets 16 in each respective Group A, B, C, and D in parallel so that the burning out of any one light bulb 15 in that respective Group A, B, C, and D will not prevent the remaining bulbs in that Group from lighting. The wiring 17 directly connects the respective Groups of light bulbs with the color organ 20 housed in a box 25 supported on the base 34 of the frame 12.

While the frame 12 is adapted for pivotal mounting on a stand 19, as shown in Fig. 1, the frame 12, because of the triangularly-shaped side members 31, is equally suitable to be stood on the floor F. If mounted on the stand 19, the display device can be pivoted on the stand 19 to adjust the orientation of the faceplate 14 relative to vertical. However, the frame 12 orients the faceplate 14 at an angle of approximately 10 degrees facing upwardly from the floor F when the display device 10 is stood on the floor F. This angle of inclination has been found to be aesthetically preferable with respect to the display of images from the device 10. In the embodiment shown in FIGS. 1–3, the color organ 20 has three wires 37, 38 and 39 extending externally therefrom. Two wires 37, 38 go to the two stereo speakers or other sound producing equipment for the input of sound signals to the input jack 21 of the color organ 20, while the third wire 39 provides a source of electrical current to the color organ 20 and corresponds to the plug 29 in FIG. 13.

Figure 2:
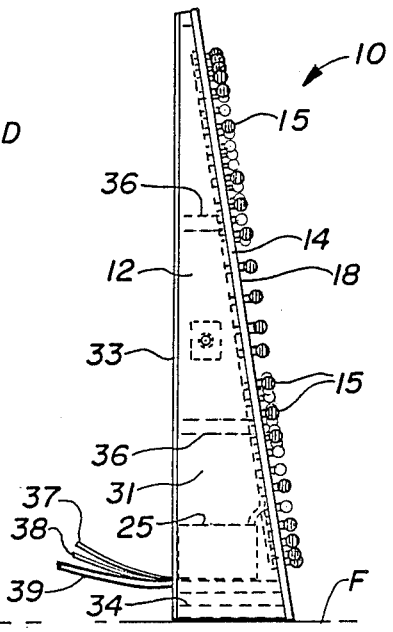
FIG. 2 is a side elevational view of the color organ display device removed from the display stand and sitting on the floor.
Figure 3:
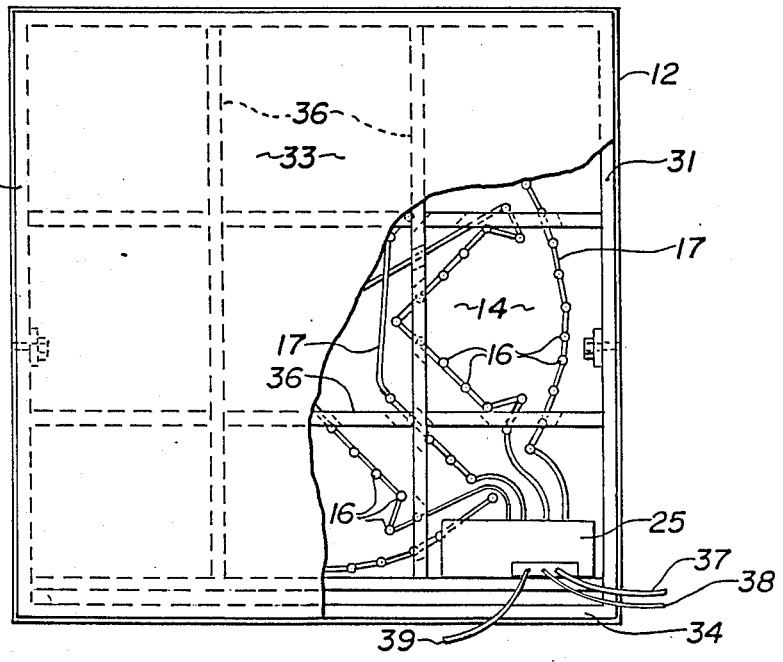
FIG. 3 is a rear elevational view of the color organ display device shown in FIG. 2 with a portion of the back being broken away to better show the frame of the device and the wiring to the light bulbs.
Figure 4:
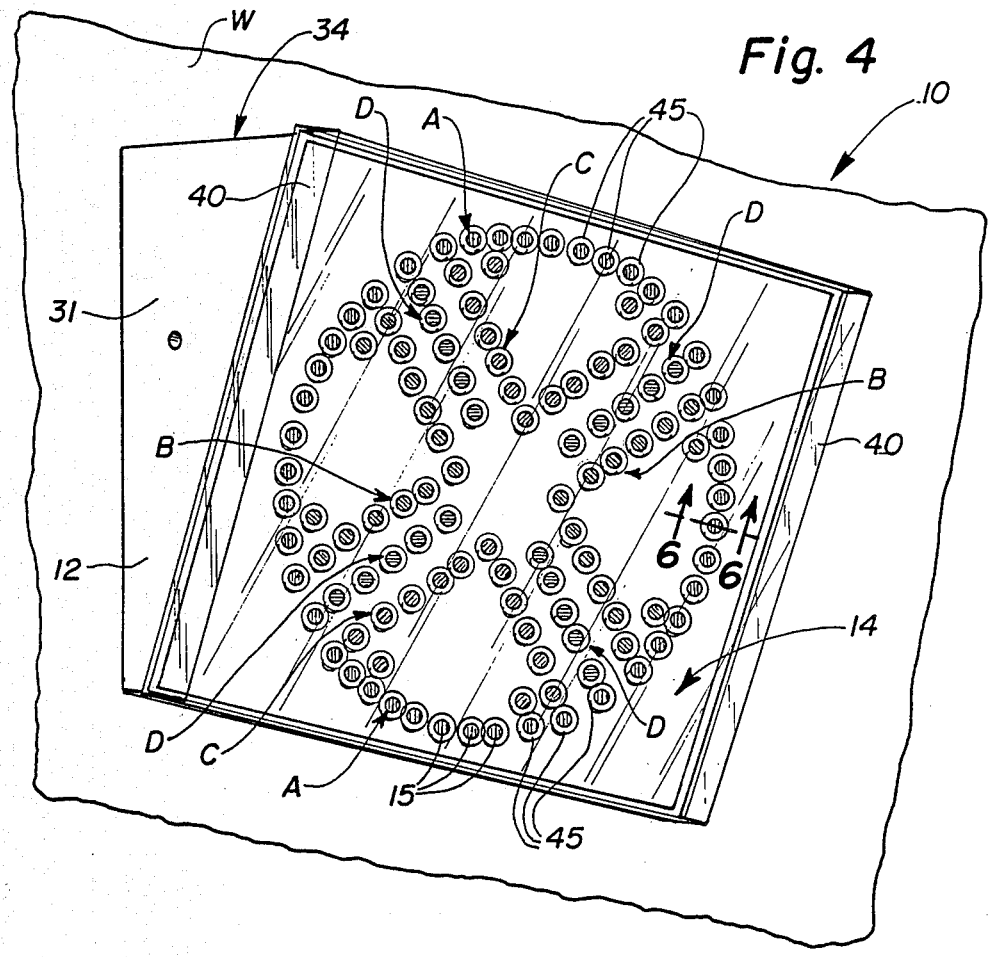
FIG. 4 is a perspective view of an alternative embodiment of the color organ display device mounted on a wall, the frame having an optional transparent cover affixed thereto over the light bulbs to protect the bulbs from damage.
Figure 6:
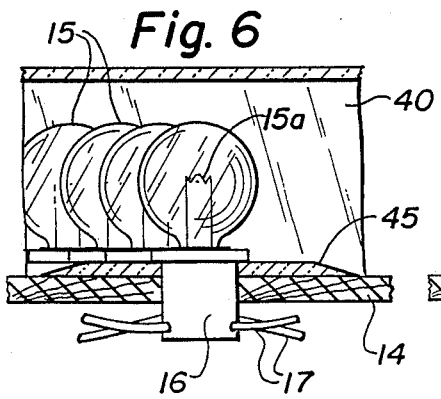
FIG. 6 is a partial cross-sectional view of the display device embodiment corresponding to lines 6—6 of FIG. 4 showing the details of the reflective disks mounted behind the light bulbs and the transparent cover protecting the bulbs from damage.

Referring now to the embodiment of the color organ display device 10 shown in FIGS. 4 and 6, it can be seen that the frame 12 can be mounted on a wall W in a reverse orientation to that described with respect to FIG. 2 above, with the faceplate 14 angled downwardly toward the floor at an angle of approximately 10 degrees. Additionally, the frame 12 can also be adapted to affix a transparent cover 40 to protect the light bulbs 15 from damage due to impact from external objects. This cover 40 can also be used in the embodiments shown in FIGS. 1 and 2; however, the cover is preferably transparent on both the top and sides so that the images generated from the Groups A, B, C, and D of light bulbs during operation will not be diffused.

The most significant difference between the display device embodiments of FIGS. 1 and 4 lies in the reflective backing 18 between the filaments 15*a* of the light bulbs 15 and the faceplate 14. In the embodiment of FIG. 1, the entire faceplate 14 was covered by the reflective backing 18, which provides a multi-angular bounce from the light rays emanating from the various light bulbs 15. In the embodiment of FIG. 4, the reflective backing 18 is in the form of circular mirrored disks 45 surrounding each individual light bulb 15. The exposed portions of the faceplate 14 would preferably be painted a non-reflective black color to emphasize the bounce of the light rays off the mirrored circular disks 45. It has been found that the image generated from the oscillatingly illuminating light bulbs is sharper and more aesthetically pleasing when a reflective backing 18 is positioned on the faceplate 14 behind the outwardly projecting light bulbs 15.

Figure 7:
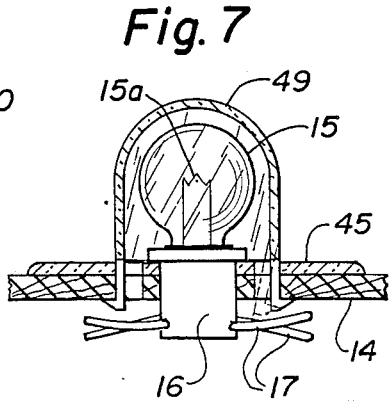
FIG. 7 is an alternative embodiment of the light bulb mounting similar to the view taken along lines 6—6 of FIG. 4.

Referring briefly to the detail view of FIG. 7, an alternative arrangement for the mounting of the light bulbs 15 and sockets 16 can be seen. Whereas the preceding description is based on the use of differently colored light bulbs 15 for the respective Groups A, B, C, and D, the arrangement of FIG. 7 could utilize white or clear bulbs 15 shining through a transparent colored dome 49 detachably snapped through the faceplate 14. Accordingly, each respective Group A, B, C, and D would have similarly colored domes 49. The reflective backing 18, shown in FIG. 7 in the form of the circular mirrored disks 45, or even in the form of a solid sheet entirely covering the faceplate 14, would surround the dome 49 to provide appropriate bounce therefrom.

With the arrangement shown in FIGS. 1–6 and 8–10, the light bulbs 15 are preferably of the type known as clear colored Christmas tree lights. Uniformity of color has been a problem that could be resolved by the arrangement of FIG. 7, as uniformity of color in the domes 49 would be more easily maintained. The utilization of the clear colored Christmas tree lights permits the filament 15*a* to be viewed directly, producing a distinct visual impression from each light bulb. The use of the arrangement shown in FIG. 7 requires that the filament 15*a* be viewed through two layers of glass which slightly obscures the filament 15*a*, but still permits a satisfactory image to be generated, with the mirrored disks positioned externally of the domes providing adequate bounce.

Referring now to FIGS. 8–10, it can be seen that the color organ display device 10 can be utilized in a table 50 to provide a unique visual display of sounds, particularly music. Tables 50 as described below are desirable in establishments in which either live or recorded music is played for the entertainment of the customers. The table 50 is comprised of a tabletop 52 mounted on a hollow pedestal 54 having appropriate leg supports 55 to provide proper stability for the table 50. The tabletop 52 incorporates a color organ display device 10 as described above but oriented in a horizontal configuration to project upwardly for the viewing pleasure of the users of the table 50.

The color organ display device 10 is shown in FIGS. 8–10 as using the circular mirrored disks 45 to attain a bounce from the illumination of the light bulbs 15. One skilled in the art will readily realize that the solid reflective backing 18 described above would be equally applicable to this embodiment. The color organ display device 10 is shown in FIGS. 8–10 to have a somewhat more compact construction than the embodiments of FIGS. 1–4. The sockets 16 for the bulbs 15 are recessed into a base member 57 in which the back side has had channels 58 routed into it for the passage of the wiring 17 interconnecting the sockets 16. A bottom cover 59 can then be affixed to the underside of the base member 57 to prevent the wiring 17 from being exposed to the users of the table 50.

A vertical sidewall 61 is mounted to the base member 57, or formed as a part thereof and extending around the outer periphery thereof to provide protection for the exposed bulbs 15 and to provide appropriate depth for the table 50. The sidewall 61 is provided with slots 62, preferably oriented horizontally, to vent the color organ display device 10 to permit a dissipation of any heat generated by the illumination of the bulbs 15 and to provide a horizontal release of light energy from the display device 10 to accentuate the visual appeal thereof. The table 50 is also provided with a transparent, preferably acrylic, top cover 65 supported by and affixed to the sidewall 61 to provide protection to the exposed bulbs 15. The top cover 65 extends outwardly beyond the sidewall 61 to provide room for the dissipation of heat from the vents 62 under circumstances where a table cloth 69 is used to cover the table 50. The optional table cloth 69 can be utilized to diffuse the light energy emanating from the color organ display device 10 as well as to mute the brightness thereof if desired.

Alternative configurations of the table 50 could include a construction of the table top 52 such that the top cover 65 has an upper and a lower half (not shown) with the optional table cloth 69 sandwiched therebetween. This particular configuration would provide a more easily maintained table for use in eating or drinking establishments. Furthermore, the description of the table 50 above could be supplemented by a coin operated device (not shown) that would control a switching mechanism (not shown) to turn the color organ display device 10 on and off as desired by the occupants of the table 50, similar to a jukebox.

As described above, the light bulbs 15 are arranged in groups A, B, C, and D for illumination in response to the detection of sound signals in corresponding frequency bands by the color organ 20. In the embodiment shown in FIGS. 8–10, the color organ 20 can be mounted in the center of the display device 10 and utilized as a support for the central portion of the top cover 65. Alternatively, the color organ 20 could be mounted below the tabletop 52 either within the hollow pedestal 54 or between the pedestal 54 and the tabletop 52. In this alternative configuration, a clear, preferably acrylic, support stand 67 could be positioned in the center of the display device 10 to support the top cover 65. The hollow pedestal 54 provides a means for passage of the electrical plug 29 and associated wiring 39 for connection with a standard supply of electrical current.

Depending on the power required to illuminate the light bulbs 15 arranged in the display device 10 and further depending on the power of the color organ 20 to drive the illumination of the light bulbs 15, one color organ 20 may be operable to drive more than on color organ display device 10. Accordingly, particularly in the embodiment seen in FIGS. 8–10, some of the display devices 10 may not have a color organ 20 physically mounted therein. Wires (not shown) interconnecting one color organ 20 and two or more display devices 10 would provide an inexpensive manner in which to utilize a plurality of tables 50, as all of the display devices 10 will be identically operating simultaneously in response to the audio input signal from the source of sound whether one color organ drives one or more than one display device.

Figure 11:
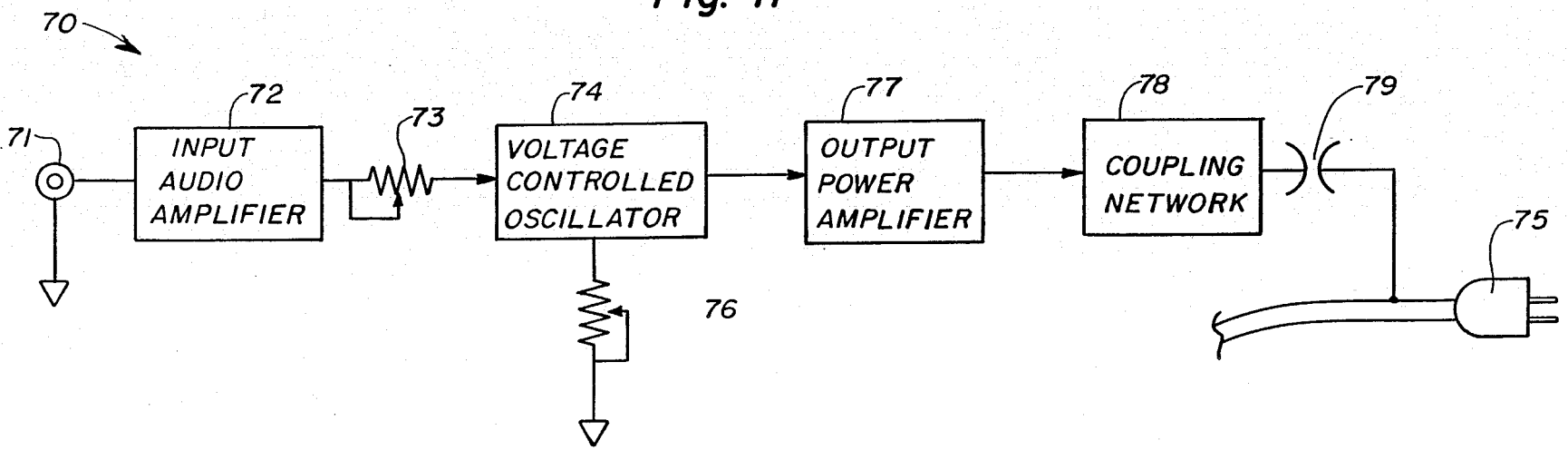
FIG. 11 is a schematic block diagram of the FM transmitter operably associated with the color organ display device to input sound signals from the source of sound to be transmitted through the electrical wiring to the color organ, the depicted transmitter being particularly applicable to the table embodiment shown in FIGS. 8–10.

FIGS. 11 and 12 depict a schematic diagram for a device for transmitting audio signals over standard 60 Hz. AC electrical wires used in the construction of buildings such as houses, nightclubs, etc., which is particularly adaptable for use with the table 50. FIG. 11 shows a block diagram for the FM transmitter 70, while FIG. 12 shows a block diagram for the FM receiver 80. Referring first to FIG. 11, the audio input from a stereo system or other similar audio source (not shown) is received by the transmitter 70 through the input jack 71. The audio signal is then processed by an input audio amplifier 72 provided with modulation adjustment 73.

A voltage controlled oscillator 74 with a center frequency adjuster 76 modulates the frequency of the signal in the range of 200 KHz. to 350 KHz. with up to 60 KHz. of deviation. The frequency modulated signal is then processed by am output power amplifier 77 and a coupling network 78, incorporating a 0.1 microfarad at 600 volts capacitor 79. The processed signal is then inputted into an AC electrical plug 75 connected to the standard electrical power lines of the building in which the display device 10 is being utilized.

The receiver 80 is then associated with the electrical plug 29 of the color organ 20. The processed signal inputted into the electrical wiring by the transmitter 70 is received through the electrical plug 29, into a capacitor 81 and a 220–340 KHz. input band pass filter 82. This signal is then processed by an input amplifier 83, a phase-locked loop 84 with VCO frequency adjuster, an output filter 86, and an output audio amplifier 87. The recovered audio signal can then be inputted to the color organ 20 through the input jack 21.

It can be seen that the use of the transmitter 70 at the source of the sound signal can input a processed signal into the wiring of an electrical circuit that can be picked up by a number of receivers 80 associated with a corresponding number of tables 50. Accordingly, the tables 50 would be operable to visually display the sound being generated at the source in the manner described above without wiring running directly to the source of the sound except for the standard AC power electrical connection. One skilled in the art will readily see the advantage of such a table arrangement in environments such as a nightclub or the like.

It will be understood that changes in the details, materials, steps and arrangement of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. For example, the types of bulbs 15 and associated sockets 16 could be of differing sizes and/or configurations. Likewise, the pattern in which the groups A, B, C, and D of light bulbs 15 are arranged can vary without departing from the scope of the invention. Furthermore, the color organ display device 10 as shown in FIGS. 1 and 4, for example, could be incorporated into other equipment or furniture such as in the back of a jukebox or the like. Accordingly, the following claims are intended to protect the invention broadly, as well as in the specific form shown.

Having thus described the invention, what is claimed is:

1. In a table having a tabletop supported above the floor by a support apparatus engagable with the floor, the improvement comprising:

a color organ display device forming a base member of said tabletop and being positioned beneath a top cover operable to permit the passage of light energy emanating from said color organ display device, which has a plurality of light bulbs arranged in groups of like color; and a color organ operably associated with said display device for receiving an audio input signal from a source of sound and effecting an illumination of said groups of light bulbs in response to said audio input signal.

2. The table of claim 1 wherein said tabletop further comprises a sidewall projecting upwardly from said base member to support said top cover above said light bulbs.

3. The table of claim 2 wherein said sidewall is provided with slots to permit the dissipation of heat generated by the operation of said color organ display device.

4. The table of claim 3 wherein said top cover is transparent and extends outwardly beyond said sidewall.

5. The table of claim 1 wherein said groups of light bulbs are arranged in a pattern, each said group of light bulbs emanating a similar color when illuminated by said color organ which is different from the color emanating from each other group of light bulbs.

6. The table of claim 5 wherein said color organ separates said audio input signal into a plurality of specified frequency bands, each respective frequency band corresponding to one of said groups of light bulbs, the brightness of the illumination of each respective said group of light bulbs being determined by the amplitude of the audio input signal detected by said color organ within the corresponding frequency band.

7. The table of claim 6 wherein said color organ display device includes a reflective backing supported by said base member beneath said light bulbs to bounce the light energy emanating therefrom upwardly through said top cover.

8. The table of claim 7 wherein said reflective backing is in the form of a solid sheet of mirrored material substantially covering all of said base member.

9. The table of claim 7 wherein said reflective backing is in the form of mirrored disks surrounding each respective said light bulb.

10. The table of claim 7 wherein said source of sound is provided with a transmitter means to transmit said audio signal into the wiring of a source of electrical power for said source of sound, each said color organ display device having a receiver means associated therewith to recover said audio signal from said source of electrical power.

11. The table of claim 10 wherein each said color organ is operably associated with more than one said color organ display device.

12. The table of claim 10 wherein said tabletop further comprises a sidewall projecting upwardly from said base member around the periphery thereof and a central support member positioned at the center of said base member to support said top cover above said light bulbs.

13. The table of claim 12 wherein said color organ is housed within said central support member.

14. The table of claim 13 wherein said base member is formed with channels therein to accommodate wiring interconnecting said light bulbs in each said group, said base member further having a bottom cover affixed thereto for covering said channels to prevent said wiring from being exposed beneath said tabletop.

* * * * *